United States Patent [19]

Lübke et al.

[11] Patent Number: 4,527,474

[45] Date of Patent: Jul. 9, 1985

[54] APPARATUS FOR IMPRESSION THROW-ON AND THROW-OFF AND, FOR CHANGING CYLINDERS, AND FOR CAUSING A LONG STROKE TO BE EXECUTED BY AN IMPRESSION CYLINDER OF A ROTARY GRAVURE PRESS

[75] Inventors: Herbert Lübke, Lienen; Winfried Stascheit, Lengerich, both of Fed. Rep. of Germany

[73] Assignee: Windmöller & Hölscher, Lengerich, Fed. Rep. of Germany

[21] Appl. No.: 659,698

[22] Filed: Oct. 11, 1984

[51] Int. Cl.[3] ..... B41F 13/24

[52] U.S. Cl. ..... 101/247; 101/153

[58] Field of Search ..... 101/141, 153, 139, 144–145, 101/191–192, 184–185, 283, 284, 285, 218, 247

[56] References Cited

U.S. PATENT DOCUMENTS

| | | | |
|---|---|---|---|
| 1,225,667 | 5/1917 | McLain | 101/284 |
| 1,337,186 | 4/1920 | Allen | 101/284 |
| 1,573,005 | 2/1926 | Kelly | 101/284 |
| 2,009,687 | 7/1935 | Cottrell | 101/284 |
| 2,601,220 | 6/1952 | Richardson et al. | 101/247 |
| 3,131,631 | 5/1964 | Haskin, Jr. | 101/247 X |
| 4,063,504 | 12/1977 | Ottenhues et al. | 101/247 |
| 4,119,031 | 10/1978 | Ottenhues | 101/247 |
| 4,132,166 | 2/1979 | Bugnone | 101/153 X |
| 4,239,001 | 12/1980 | Kataoka | 101/247 X |
| 4,240,346 | 12/1980 | Landis et al. | 101/139 |

*Primary Examiner*—E. H. Eickholt

*Attorney, Agent, or Firm*—Fleit, Jacobson, Cohn & Price

[57] ABSTRACT

In a rotary gravure press in which the journal bearings of the impression cylinder are each connected to a piston rod of the double acting piston-cylinder units serving to raise and lower the impression cylinder, the piston rods extend out of the cylinders and are rotatably but axially undisplaceably mounted in the journal bearings. On the sides opposite to the piston rods, spindles which are screwed into the pistons are provided with unthreaded portions on which worm wheels are secured against rotation but to allow limited axial displacement through a distance corresponding to the stroke between impression throw-on and throw-off.

9 Claims, 3 Drawing Figures

APPARATUS FOR IMPRESSION THROW-ON AND THROW-OFF AND, FOR CHANGING CYLINDERS, AND FOR CAUSING A LONG STROKE TO BE EXECUTED BY AN IMPRESSION CYLINDER OF A ROTARY GRAVURE PRESS

The invention relates to an apparatus for impression throw-on and throw-off and, as is necessary for changing cylinders, for causing a long stroke to be executed by an impression cylinder acting on the plate cylinder of a rotary gravure press, wherein the two journal bearings are each connected to a piston rod of the double acting piston-cylinder units serving to raise and lower the impression cylinder.

Comparatively expensive apparatuses of this kind are known from DE-PS Nos. 26 09 513, 26 38 750 and 30 46 989.

It is therefore the problem of the invention to provide a constructionally simplified and easily operable reliable apparatus of the aforementioned kind.

According to the invention, this problem is solved in that the piston rods extending out of the cylinder are rotatably but axially undisplaceably mounted in the journal bearings and that, on the sides opposite to the piston rods, spindles which are screwed into the pistons having screwthreads are provided with unthreaded portions on which worm wheels which are fixed with respect to the housing and in mesh with drivable worms are secured against rotation but to allow limited axial displacement through a distance corresponding to the stroke between impression throw-on and throw-off. In the apparatus according to the invention, the impression cylinder can be moved between impression throw-on and throw-off and vice versa simply in that the appropriate side of the piston is acted on by pressure medium, generally compressed air, and the other side is vented. The long stroke of the impression cylinder for, say, plate cylinder replacement can be brought about in that the motor driving the worms is started through a special switch to turn in the appropriate direction. After plate cylinder replacement, the motor driving the worms can be switched on again in the opposite direction until the impression cylinder is placed on the plate cylinder and pressed there against at the pressure of the pressure medium. In this position, the worm drive is brought to a standstill so that the impression cylinder is movable between impression throw-on and throw-off only by way of the piston by pressure medium acting on the appropriate side of the piston.

From DE PS No. 12 35 333, it is basically known to use a piston-cylinder unit to bring about the movements for throw-on and throw-off of an impression cylinder mounted in a horizontally displaceable carriage. The piston-cylinder unit is so connected to a spindle drive that the spindle can be moved by a worm drive independently of the piston movement.

Desirably, to limit the axial play corresponding to the piston stroke between throw-on and throw-off, the spindle is supported on the ends of the hub of the worm wheel by way of abutments formed on the one hand by a collar and on the other hand by a clamping ring. In the throw-on position, the abutment can be disposed at a slight spacing above the upper end of the hub of the worm wheel so that the impression cylinder is pressed against the plate cylinder at the set pressure of the pressure medium.

In a further embodiment of the invention, the spindle is mounted at its rear portion in a bushing which is connected to a radial arm that is guided in an elongate hole of the housing and cooperates with a switch of the motor driving the worm. This switch serves to switch off the worm drive when the impression cylinder has been applied to the plate cylinder. For this purpose, the switching point of the switch, which is preferably a microswitch, can be selected so that switching takes place when the abutment of the spindle located on the side of the worm wheel opposite to the cylinder is lifted off the worm wheel hub. If the upper cylinder chamber is supplied with pressure, during the throw-on movement of the spindle the play between the upper abutment and the worm wheel hub is eliminated to begin with. When the impression cylinder has been moved towards the plate cylinder to such an extent that it rests thereon, the piston cannot move downwardly any further so that, upon further spindle rotation, the abutment is lifted from the top of the worm wheel hub and the impression cylinder is pressed against the plate cylinder with the full pressure of the pressure medium. The slight lifting movement of the abutment is utilised to switch off the motor that drives the worms.

In a development of the invention, the spindle is provided with a collar in the region of the housing. A spring-influenced locking bolt which is displaceable in the housing radially of the spindle engages under the collar and is connected to a piston which unlocks same when pressure medium acts on the cylinder chamber for moving the piston to the throw-on position. This locking bolt prevents the impression cylinder from falling onto the plate cylinder in the throw-off position if the pressure of the pressure medium should fail.

To enable the impression cylinder to be set accurately, worm wheels are keyed on the piston rods in the region of the journal bearings and they are in mesh with worms serving for fine adjustment. The desired fine setting can be effected by way of handwheels.

One example of the invention will now be described in more detail with reference to the drawing, wherein.

Figure 2:
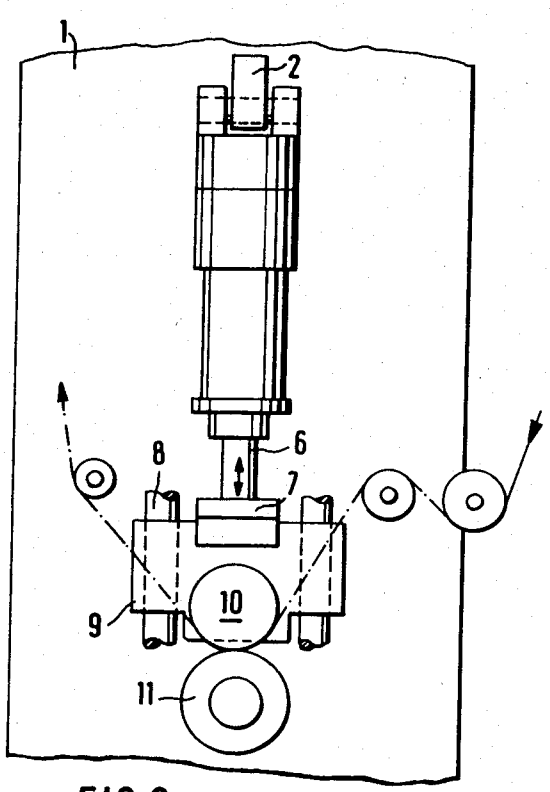
FIG. 2 is a side elevation of the FIG. 1 part of the gravure press.
Figure 1:
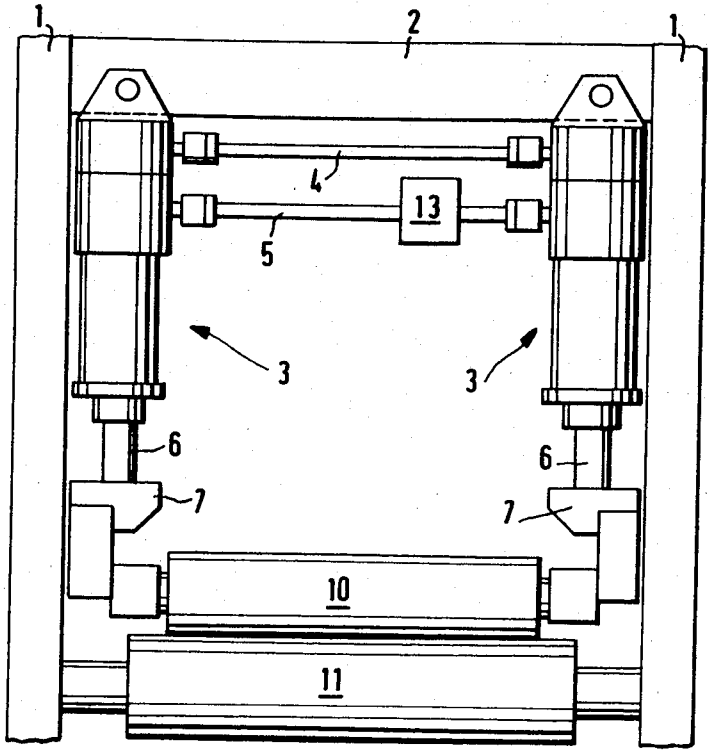
FIG. 1 is a diagrammatic front elevation of part of a gravure press.

The two side frames 1 of a gravure printing press are securely interconnected by a cross member 2. Two pneumatic piston-cylinder units 3 are suspended from the cross member 2 and are interconnected by way of cardan shafts 4 and 5 mounted in the frame. As is shown in FIG. 1, the cardan shaft 5 is divided into two, each one end of the divided shaft 5 being flange-connected to the stationary gearing motor 13. The piston rods 6 of the piston-cylinder units 3 each carry a bearing 7 which is connected to a respective block bearing 9 guided on rods 8. The block bearings serve to mount the impression cylinder 10 which can be applied to the plate cylinder 11 by way of the piston-cylinder units 3 for printing purposes and is lifted off same by a small amount during short stoppages and by a larger amount when the plate cylinder is to be changed. For this purpose, the piston-cylinder units 3 have a special construction which is evident from FIG. 3.

The end of the piston rod 6 projecting from the cylinder tube 12 has an attachment member 14 which is so screw-connected to the bearing 7 by way of roller bearings that it is held therein against axial displacement but may turn in the bearing 7. For this purpose, the attachment member 14 carries a worm wheel 15 in mesh with a manual adjustable worm 16. One end of the cylinder tube 12 is closed by a cover 17 having an air inlet and outlet aperture 18. A nut 20 which is secured against rotation is screw connected to the piston 19 connected to the piston rod 6 and has an internal screwthread 21. This internal screwthread 21 engages an external screwthread 22 which is formed on a rod 23 held at one end in the hollow piston rod 6 by way of bearings 24. The side of the cylinder tube 12 opposite to the cover 17 is closed by a housing 25 having a throughgoing stepped bore 26. In this bore 26, the extension 27 of the rod 23 is rotatable and slightly axially displaceable. As will be evident from FIG. 3, the external screwthread 22 is adjoined by a locking lug 28 in the form of an annular collar. In the illustrated position, a bolt 29 lies against the back of the collar under the force of the spring 30. This spring 30 is supported at the side remote from the bolt 29 on the inside of a cover 31 which is fixed, for example by screws 32, to the housing 25 in a manner not shown. The bolt 29 has an upper collar 33 which, in the illustrated position, closes an air hole 34 provided in the housing 25. This air hole 34 opens into a larger air supply bore 35 which communicates on the one hand with a source of compressed air (not shown) and on the other hand terminates in front of the cylindrical portion of the bolt 29.

Adjoining the locking lug 28, a worm wheel 36 placed on the extension 27 is secured against rotation by means of a spring 37 but can move axially between the worm wheel 36 and the extension 27. The worm wheel 36 is driven by the cardan shaft 5 driven by way of the gearing motor 13. Adjoining the worm wheel 36, a clamping A ring 38 is secured to the extension 27, namely at the spacing from the worm wheel 36. Thus, the extension 27 and consequently the rod 23 can be moved to the right relatively to the worm wheel 36 by this distance A. The end of the extension 27 remote from the rod 23 carries a bushing 39 connected to the extension 27 by way of ball bearings 40. A switching cam 41 screw connected to the bushing 39 is movable to a small extent to the left or right in a longitudinal slot 42 provided in the housing 25. The end of the switching cam 41 remote from the bushing 39 has a ramp 43 which rises towards the right and against which there lies the switching lever 44 of a microswitch 45. By reason of the fact that the switching cam 41 is guided in the longitudinal slot 42, the bushing 39 is secured against rotation. The part of the bushing 39 diametrally opposite to the switching cam 41 comprises spur gearing 46 engaging the gear 47 which is secured to one end of the cardan shaft 4.

There now follows a description of the function of the apparatus.

As already mentioned previously, it is necessary to permit the impression cylinder 10 to be brought into three different positions. More particularly, the impression cylinder 10 must assume a position in which it lies on the plate cylinder 11 at a predetermined pressure required for printing. On changing the plate cylinder, the impression cylinder must be lifted off completely to obtain working space. During short stoppages of the machine, the impression cylinder 10 need be lifted off the plate cylinder by only a small amount so that the inking mechanisms can continue to run to prevent the printing ink from drying out.

Figure 3:
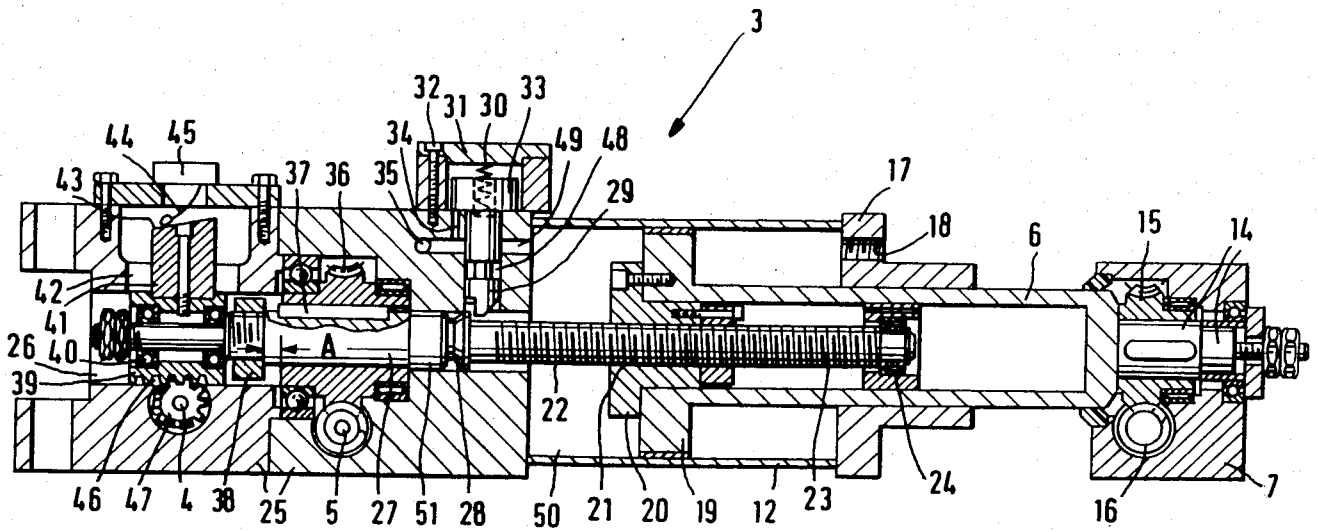
FIG. 3 is a longitudinal section of the pneumatic cylinders shown in FIGS. 1 and 2.

In FIG. 3 position of the piston rod 6 of the piston-cylinder unit 3, the bearing 7 and thus the impression cylinder 10 are lifted off the plate cylinder by a small amount, i.e. the machine is in the so-called throw-off position. If it is now desired to print, air is supplied through the air supply bore 35 and, by way of the air hole 34 moves the collar 33 of the bolt 29 and thus the bolt 29 itself upwardly against the force of the spring 30 so that the locking lug 28 is no longer locked. During movement of the bolt 29 against the force of the spring 30, the annular groove 48 moves into the region of the compressed air bore 35 so that air reaches the cylinder chamber 50 through the annular groove 48 and a further hole 49, whereby the piston 19 is displaced to the right until the clamping ring 38 lies against the worm wheel 36. This distance A corresponds to the spacing of the impression cylinder from the plate cylinder 11 in the throw-off position. Thus, when the clamping ring 38 has been moved against the worm wheel 36, the impression cylinder 10 at the same time lies on the plate cylinder 11 and printing can take place.

Depending on the material to be printed, however, a fine adjustment must now be undertaken by hand. This is effected by a handwheel (not shown) with which the worm wheel 15 and thus the worm 16 can be turned. By turning the worm 16, the piston rod 6 will also turn, as well as the nut 20 engage with its internal screwthread 21 on the external screwthread 22 of the rod 23. Since the rod 23 is secured against rotation by the retaining cam 41, the piston 19 is displaced in the cylinder tube 12, whereby the impression cylinder 10 can be adjusted for height for the purpose of fine regulation depending on the material to be printed.

If, now, the plate cylinder is to be replaced, a switch (not shown) is operated to turn the gearing motor 13 in a direction such that the spindles lift the impression cylinder off with the desired long stroke. For this purpose, at least the upper cylinder chamber can be vented so that retraction of the piston need not take place against the pressure of the pressure medium. The upper limiting position of the long stroke can be determined by a terminal switch (not shown) which switches the gearing motor 13 off.

If, after replacing the plate cylinder, the impression cylinder is now to be re-applied thereto, the gearing motor 13 is again switched on by a switch (not shown) in a direction such that the impression cylinder is lowered. During this application of the impression cylinder, the lower cylinder chamber is vented so that the abutment formed by the clamping ring 38 lies against the hub of the worm wheel 36 without play. If, now, the impression cylinder lies against the plate cylinder, the clamping ring 38 lifts off the worm wheel hub during continued rotation of the spindle 23 and this axial motion of the spindle relatively to the housing 55 is utilised to actuate the switching lever 44 of the microswitch 45 by way of the ramp 43 of the switching cam. Upon lifting the setting ring 38 off the hub of the worm wheel 36 the microswitch 45 switches the gearing motor 13 off and normal printing operation can commence.

By applying compressed air to the lower cylinder chamber, the impression cylinder is then moved to the throw-off position. To re-apply the impression cylinder to the plate cylinder, the lower cylinder chamber is vented and the upper cylinder chamber 50 is supplied with compressed air, for example at a pressure of three bar.

In the impression throw-off position, where the lower cylinder chamber is provided with compressed air, the collar 51 of the spindle 23 is supported on the lower end of the worm wheel hub 36. This position is shown in FIG. 3.

If it is found that the impression cylinder is not correctly positioned in relation to the plate cylinder after a plate cylinder change or during printing, fine adjustment can be undertaken by way of the worm wheel gearing 15, 16.

We claim:

1. Apparatus for impression throw-on and throw-off and, as is necessary for changing cylinders, for causing a long stroke to be executed by an impression cylinder acting on the plate cylinder of a rotary gravure press, wherein the two journal bearings are each connected to a piston rod of the double acting piston-cylinder units serving to raise and lower the impression cylinder, characterised in that the piston rods (6) extending out of the cylinders (12) are rotatably but axially undisplaceably mounted in the journal bearings (7) and that, on the sides opposite to the piston rods (6) spindles (23) which are screwed into the pistons (19) having screwthreads (21) are provided with unthreaded portions on which worm wheels (36) which are fixed with respect to the housing and in mesh with drivable worms (4) are secured against rotation but to allow limited axial displacement through a distance corresponding to the stroke between impression throw-on and throw-off.

2. Apparatus according to claim 1 characterised in that each worm wheel (36) is mounted in a housing (25) which is securely connected to the cylinder (12) and sealed from the spindle (23) introduced therein.

3. Apparatus according to claim 1 characterised in that, to limit the axial play (A), the spindle (23) is supported on the ends of the hub of the worm wheel (36) by abutments formed on the one hand by a collar (51) and on the other hand by a clamping ring (38).

4. Apparatus according to claim 1 characterised in that the spindle (23) is mounted at its rear portion in a bushing (39) which is connected to a radial arm (41) that is guided in an elongate hole (42) of the housing (25) and co-operates with a switch (44,45) of the motor driving the worm (4).

5. Apparatus according to claim 1 characterised in that the switching cam formed by the radial arm (41) switches the motor off when the abutment (38) of spindle (36) disposed on the side of the worm wheel (36) remote from the cylinder is lifted off the worm wheel hub.

6. Apparatus according to claim 1 characterised in that the bushings (39) are provided with spur gearing (46) engaged with pinions (47) secured to a synchronising shaft (4).

7. Apparatus according to claim 1 characterised in that the spindle (23) is provided in the region of the housing (25) with a collar (28) behind which there is engaged a spring-loaded locking bolt (29) which is displaceably guided in the housing (25) radially of the spindle (23) and connected to a piston (33) which unlocks same when the cylinder chamber (50) moving the piston (19) to the throw-on position is subjected to pressure medium.

8. Apparatus according to claim 1 characterised in that the locking bolt (29) is bevelled at the side facing the piston (19) so that it can be transferred from the collar (28) along the path to the throw-off position.

9. Apparatus according to claim 1 characterised in that worm wheels (15) keyed to the piston rods (6) in the region of the journal bearings (7) engage with worms (16) serving for fine adjustment.

* * * * *